United States Patent [19]

Best

[11] 4,267,435

[45] May 12, 1981

[54] ELECTRIC RESISTANCE HEATING ELEMENT

[75] Inventor: Albert B. Best, Danbury, Conn.

[73] Assignee: The Kanthal Corporation, Bethel, Conn.

[21] Appl. No.: 68,767

[22] Filed: Aug. 23, 1979

[51] Int. Cl.[3] ..... H05B 3/10

[52] U.S. Cl. ..... 219/552; 219/101; 219/270; 219/553; 338/283; 338/295; 338/329

[58] Field of Search ..... 219/270, 460, 464, 532, 219/552, 553, 101, 118; 338/51, 218, 316, 329, 318, 330, 295; 361/264, 265, 266–283, 285, 289

[56] References Cited

U.S. PATENT DOCUMENTS

| | | | |
|---|---|---|---|
| 2,772,337 | 11/1956 | DuBois | 338/318 X |
| 2,848,586 | 8/1958 | Wainer et al. | 338/330 |
| 2,993,111 | 7/1961 | Schrewelius et al. | 219/118 |
| 3,237,144 | 2/1966 | Joeckel | 338/318 X |
| 3,269,806 | 8/1966 | Fitzer et al. | 338/330 X |
| 3,522,574 | 8/1970 | Giler | 338/51 X |
| 3,569,787 | 3/1971 | Palmer | 361/264 X |
| 3,668,599 | 6/1972 | Schrewelius | 338/289 |
| 3,912,905 | 10/1975 | Giler | 219/464 |
| 4,146,868 | 3/1979 | Kirilloff et al. | 338/295 |

*Primary Examiner*—Volodymyr Y. Mayewski
*Attorney, Agent, or Firm*—Kenyon & Kenyon

[57] ABSTRACT

An electric resistance heating element is formed by a molybdenum disilicide wire loop formed by separate lengths of the wire having ends positioned together and butt welded to the end of a molybdenum disilicide connecting wire of larger diameter than that of the lengths. The lengths diverge from each other so they are electrically separated. Electrical connections with the free ends of the separate lengths of wire can provide for electrically powering the loop.

6 Claims, 4 Drawing Figures

Fig. 1.
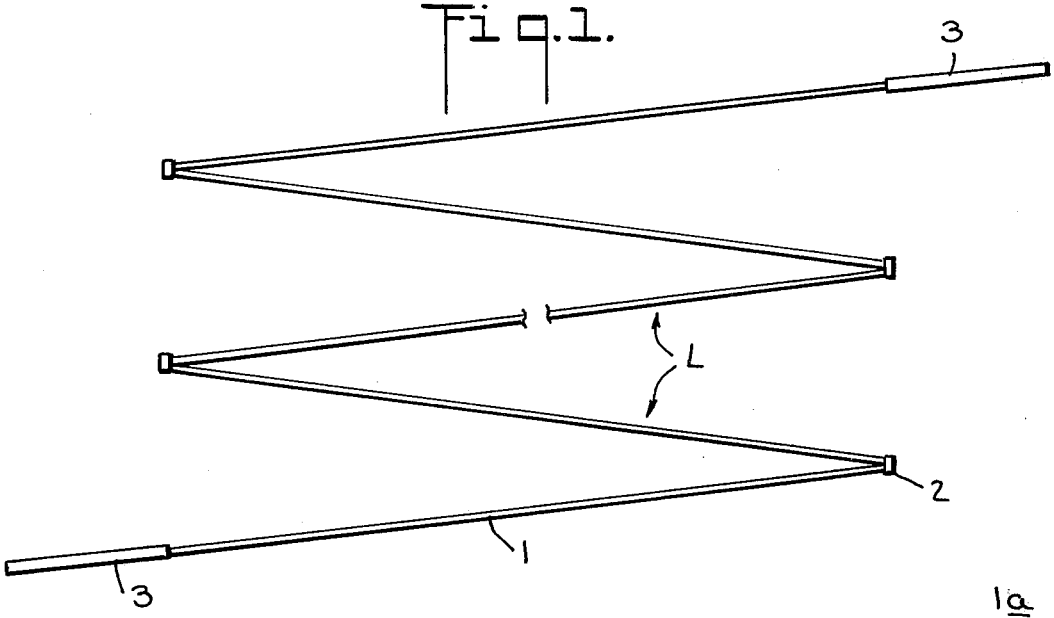
Fig. 4.
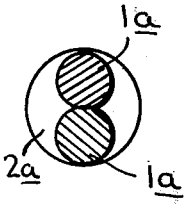
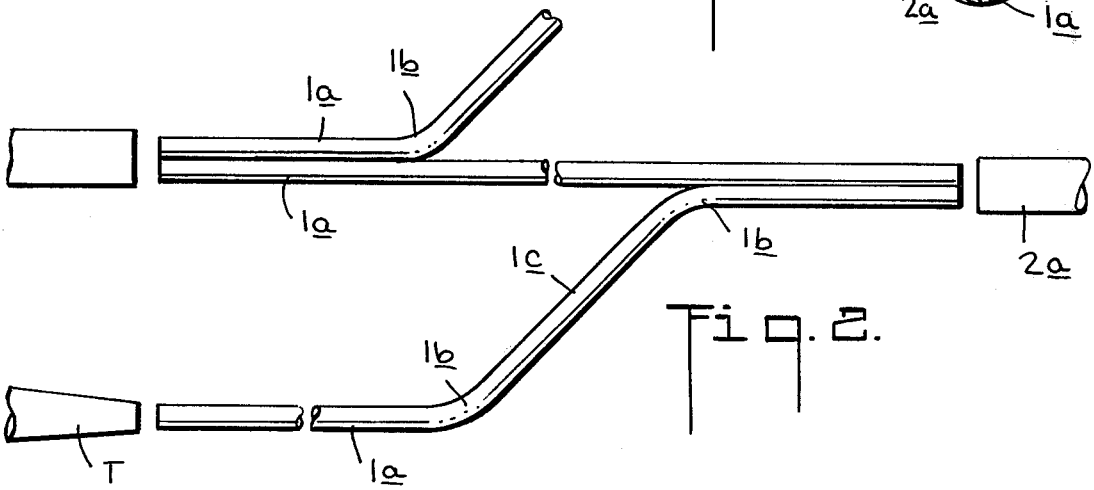
Fig. 2.
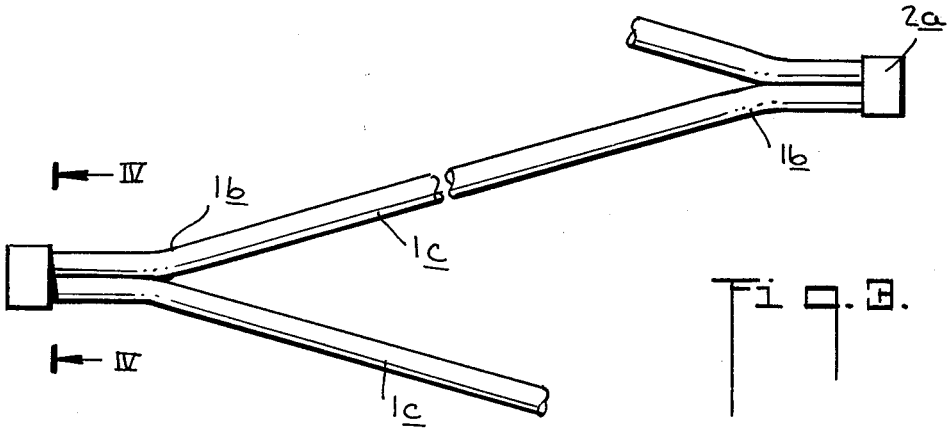
Fig. 3.

ELECTRIC RESISTANCE HEATING ELEMENT

BACKGROUND OF THE INVENTION

Electric resistance heating elements using metal alloy resistance wire have the advantage that the wire can be cold bent more or less sharply. The wire can be cold bent to form loops, zigzag shapes, etc., simplifying manufacture of the elements.

Molybdenum disilicide wire, exemplified by wire sold under the trademark "KANTHAL SUPER", can operate at higher temperatures than any metal alloy wire, but it is brittle when cold and requires heating to high temperatures for bending. This characteristic has not prevented successful commercialization of molybdenum disilicide hairpin elements formed by a single long loop of the wire and designed for relatively heavy-duty industrial use, with the necessary bend formed at the high temperature required. It has retarded the use of molybdenum disilicide wire in connection with the commercial manufacture of domestic heating appliances such as is exemplified by the cooking stove hot plate described by the U.S. Giler Pat. No. 3,912,905 where a heating grid formed by molybdenum disilicide wire looped back and forth in sinuous of zigzag formation is illustrated.

In all cases it is desirable to eliminate the necessity for heating molybdenum disilicide wire whenever it is necessary to form the wire into a loop requiring a relatively sharp bend from which mutually separated lengths of the wire extend and particularly when a number of loops are required by a single element such as in the case of a cooking stove hot plate.

DESCRIPTION OF THE INVENTION

The present invention is an electric resistance heating element comprising at least one molybdenum disilicide wire loop formed by separate straight lengths of the wire having ends positioned together and butt welded to the end of a molybdenum disilicide wire of larger diameter than that of the lengths, the lengths diverging from each other so that they are electrically separated from each other. Any number of such loops can be formed in interconnected succession so that they can operate electrically in series.

Molybdenum disilicide wire is commercially sold in straight lengths and with a wide range of diameters. With the present invention, such commercial wire can be used, using a smaller diameter for the straight lengths and a larger diameter for what can be called the connecting wires.

This new element concept lends itself to automated production methods. The straight lengths and connecting wire can be automatically positioned as required, clamped, pushed together, and by electric resistance heating, brought to the welding temperature quickly. Such heating is localized entirely at the weld location. The connecting wire can be long for easy clamping and then automatically cut close to the weld.

With the connecting wire having a diameter only twice that of the lengths, the total cross-sectional area of the two lengths and the cross-sectional area of the connecting wire are approximately equal, so the butt welding operation is entirely practical. With rectangular wire, the two areas can be made precisely equal to each other.

The two lengths can be angularly related with respect to each other and the connecting wire so that the straight lengths diverge from each other and are electrically separated. As an alternative, particularly applicable to the heavier duty industrial hairpin type of element, the two wires can be kept mutually parallel with each other and with the connecting wire during the butt welding, and thereafter with appropriate heating at least one length reversely bent slightly so that the two lengths are separated from each other. Although in such a case heating is necessary, the degree of bending is very slight as compared to that required to make an element with a 180° bend.

Incidentally, even with appropriate heating, a 180° bend in molybdenum disilicide wire is difficult to make without some breakage. The slight bending referred to above does not involve the same stresses.

Although with the present invention the loop end is formed by a Y joint instead of a U bend, the end result is the same insofar as an electrical resistance heating element is concerned.

With the present invention a plurality of the loops can be made in series and positioned in the same flat plane to form a grid adapted for use as illustrated by the Giler patent, in this case using wire of the small diameter indicated by that patent. A further advantage is obtained in that the short lengths or studs of connecting wire remaining after cutting can be used as a grid mounting which, as described by the Giler patent, has presented problems.

The heavier hairpin elements have heretofore been suspended by their legs only, but by using the present invention, the connecting wire pieces are available to provide steadying support points.

A further advantage of the short pieces of connecting wire left butt welded to the straight lengths of wire is that heat at the joints is reduced because of the larger mass of the connecting wire pieces as compared to the diameter of the straight lengths.

BRIEF DESCRIPTION OF THE DRAWINGS

The accompanying drawings are intended only to schematically illustrate the foregoing principles, the various views being as follows:

FIG. 1 is a plan view of a grid form of the invention;

FIG. 2 on an enlarged scale illustrates a second form with the parts arranged for butt welding;

FIG. 3 shows a further form with the parts butt welded together; and

FIG. 4 is a cross section taken on the line IV—IV in FIG. 3.

DETAILED DESCRIPTION OF THE DRAWINGS

In FIG. 1 the separate straight lengths of molybdenum disilicide wire are shown at 1 with the short pieces of straight connecting molybdenum disilicide wire 2 butt welded to the ends of the wires 1 in end-to-end relationship so as to form a plurality of molybdenum disilicide wire loops L, all positioned in the same plane and side-by-side so as to form a grid of a type suitable for use as illustrated by the Giler et al patent. The wire 1 is 0.6 mm wire and the terminal wire is 1.5 mm, such diameters being commercially available. Terminals 3 made of longer lengths of the thicker wire are connected to the free ends of the series of loops L. The terminals may be fastened to the free ends of the outermost two of the wires 1, by butt welding. The terminals 3 need not necessarily also be molybdenum disilicide wire, it being possible to connect them by following the principles disclosed by the U.S. Giler Pat. No. 3,522,574. Butt welding of two molybdenum disilicide parts together is difficult or impossible unless the two parts are of substantially the same cross-sectional area. Tapering of the welded ends of the terminals is advisable if they are made of molybdenum disilicide.

The connecting wires 2 may initially be of much longer length for convenience when clamping the various wires together for electric resistance butt welding, and being thereafter cut to shorter lengths. In FIG. 1 the wires 1 are angularly related with respect to each other and to the connecting wire parts 2. Although the total cross-sectional area of the two 0.6 mm wires does not precisely equal that of the 1.5 mm molybdenum disilicide terminal wire ends, the approximation obtained is adequate to permit effective butt welding of the parts by the electric resistance method.

FIG. 2 provides an example wherein the wire lengths 1*a* are positioned parallel to each other and to the terminal wires 2*a*. The parts are shown as positioned just prior to butt welding, and although the jigs and clamps that would normally be used for production purposes are not illustrated, it can be seen that there is no difficulty in arranging the parts and clamping by automated equipment which would then push the wire ends together and by electric resistance heating effect the butt welding. Thereafter, by local heating, the wires 1*a* can be reversely bent slightly as indicated at 1*b* so that the two legs of the resulting loop or loops are parallel to each other but separated by reason of the portion 1*c* which causes the two wires in that area to diverge from each other to the extent required for separation. Assuming the wires are of relatively large diameter, the terminal T could be tapered by machining, as illustrated, to provide a diameter match, the terminal being made of molybdenum disilicide.

FIG. 3 serves to show that both of the two wires of each loop can be reversely bent so that each two diverges adjacent to their interconnected ends.

For bending of the molybdenum disilicide loop wire legs, the necessary heating may be effected locally either by electric resistance heating or by the use of a torch, to provide the temperature required for bending without undue risk of breaking. As shown by the drawings, in any case the bend required is very gentle, or to a relatively large radius, as compared to that required by the bends of the wire loops illustrated by the Giler U.S. Pat. No. 3,912,905, or which are required to form the prior art molybdenum disilicide hairpin type of electric resistance element. The same type of element can be made by the present invention as a single loop with the loop end formed by the Y joint of butt welded straight wires.

Using principles of this invention, various configurations of molybdenum disilicide wire heating elements is made possible without wire bending problems. The invention is of particular value when the wire must be formed as one or more loops or, in other words, in a form involving at least two relatively long legs having their ends interconnected with the legs extending in side-by-side relationship but separated from each other.

However, advantageous variations of the foregoing are possible. The material described might be replaced by other refractory metal silicides should they become commercially available at a reasonable cost. The connecting wires 2 or 2*a* need not be cut so short as suggested but can be longer as indicated by FIG. 2, to provide for heat sinks keeping the welded areas cooler during operation, afford better mounting or loop-guiding possibilities, etc.

When the FIG. 1 type of device is involved, the straight lengths 1 can be initially positioned substantially parallel to each other but a little out of contact and with the connecting wires 2 left uncut and long enough to provide for gripping. Then the assembly can be electrically powered for heating to the bending temperature of the lengths, and using the long connecting wires as handles through which bending force can be applied, the assembly can be formed as desired. Cylindrical or other contours are possible, as well as the flat plane arrangement shown by FIG. 1.

What is claimed is:

1. An electric resistance element including at least one loop made of refractory metal silicide resistance wire and comprising separate lengths of said resistance wire, said separate lengths of said resistance wire each having one end positioned next to one end of the other length of resistance wire with said ends facing in the same direction, both of said ends of said separate lengths of said resistance wire being butt welded to an end of a refractory metal silicide connecting wire, said end of said connecting wire facing in a direction opposite to said direction in which said ends of said separate lengths of said resistance wire face, said connecting wire having a diameter approximately equal to the both diameters of said separate lengths of said resistance wire, and said separate lengths of said resistance wire diverging from each other so as to form said loop.

2. The element of claim 1 in which the total cross-sectional area of said separate lengths of said resistance wire is less than the cross-sectional area of said connecting wire.

3. The element of claim 1 in which said connecting wire has a length that is short as compared to said separate lengths of said resistance wire.

4. The element of claim 1 in which said separate lengths of said resistance wire are straight throughout their extents and at least one of said separate lengths of said resistance wire extends angularly from said connecting wire.

5. The element of claim 3 in which an interconnected plurality of said loops are positioned in one plane to form an electric resistance heating grid.

6. The element of claim 5 in which two of said lengths have free ends connected to wires of larger diameter than the lengths and are arranged to form terminals for said grid with the balance of said lengths in series connection with each other.

* * * * *